US009203162B2

(12) United States Patent
Kyhle

(10) Patent No.: US 9,203,162 B2
(45) Date of Patent: Dec. 1, 2015

(54) DEVICE FOR SWITCHING BETWEEN LINEAR AND CIRCULAR POLARIZATION USING A ROTATABLE DEPOLARIZER

(75) Inventor: Anders Kyhle, Malmö (SE)

(73) Assignee: THRANE & THRANE A/S, Lyngby (DK)

( * ) Notice: Subject to any disclaimer, the term of this patent is extended or adjusted under 35 U.S.C. 154(b) by 0 days.

(21) Appl. No.: 14/003,614

(22) PCT Filed: Feb. 29, 2012

(86) PCT No.: PCT/EP2012/053405

§ 371 (c)(1), (2), (4) Date: Oct. 25, 2013

(87) PCT Pub. No.: WO2012/119898

PCT Pub. Date: Sep. 13, 2012

(65) Prior Publication Data

US 2014/0152404 A1 Jun. 5, 2014

Related U.S. Application Data

(60) Provisional application No. 61/450,769, filed on Mar. 9, 2011.

(51) Int. Cl.

| | |
|---|---|
| ***H01Q 21/24*** | (2006.01) |
| ***H01P 1/06*** | (2006.01) |
| ***H01P 1/17*** | (2006.01) |

(52) U.S. Cl.

CPC ..... *H01Q 21/245* (2013.01); *H01P 1/065* (2013.01); *H01P 1/17* (2013.01); *H01P 1/172* (2013.01)

(58) Field of Classification Search

CPC ..... H01P 1/172; H01P 1/065; H01P 1/17; H01Q 21/245

USPC ..... 333/21 A, 21 R, 137, 157, 248, 254, 256; 343/756

See application file for complete search history.

(56) References Cited

U.S. PATENT DOCUMENTS 3,720,947 A 3/1973 Meyer et al.
4,178,574 A * 12/1979 Edens et al. ..... 343/756

(Continued)

FOREIGN PATENT DOCUMENTS

EP 1154510 A2 11/2001
JP S59055601 A 3/1984

OTHER PUBLICATIONS

International Search Report PCT/ISA/210 for PCT/EP2012/053405 dated May 31, 2012.

(Continued)

*Primary Examiner* — Benny Lee
*Assistant Examiner* — Jorge Salazar, Jr.
(74) *Attorney, Agent, or Firm* — Harness, Dickey & Pierce, P.L.C.

(57) ABSTRACT

A system for receiving a signal from one or more satellites or for transmitting a signal to one or more satellites and a method of operating the system, the system comprising a frame, a signal converter for converting between a received/transmitted signal and a corresponding signal, the converter being positioned, in relation to the frame, rotational around a predetermined axis, and a depolarizer mounted, in relation to the frame, rotational around the predetermined axis, the method comprising the sequence of steps of rotating one of the converter and the depolarizer independently of the other of the converter and the depolarizer, fixing the depolarizer in relation to the converter at a predetermined rotational relationship and rotating both the converter and the depolarizer.

2 Claims, 2 Drawing Sheets

(56) References Cited

U.S. PATENT DOCUMENTS

| | | | |
|---|---|---|---|
| 4,198,641 | A | 4/1980 | Gibson |
| 4,528,528 | A | 7/1985 | Augustin |
| 4,613,836 | A | 9/1986 | Evans |
| 4,806,945 | A | 2/1989 | Cormier et al. |
| 5,068,671 | A | 11/1991 | Wicks et al. |
| 5,086,301 | A | 2/1992 | English et al. |
| 5,172,081 | A | 12/1992 | Gabriel et al. |
| 5,563,613 | A | 10/1996 | Schroeder et al. |
| 5,812,096 | A | 9/1998 | Tilford |
| 6,150,984 | A | 11/2000 | Suguro et al. |
| 6,404,298 | B1 | 6/2002 | Rohr et al. |
| 6,693,497 | B2 | 2/2004 | Scott et al. |
| 6,864,850 | B2 | 3/2005 | Imaizumi et al. |
| 7,564,420 | B2 | 7/2009 | Jeon et al. |
| 7,659,867 | B2 | 2/2010 | Hasegawa et al. |
| 2002/0154402 | A1 | 10/2002 | Scott et al. |

OTHER PUBLICATIONS

Written Opinion PCT/ISA/237 for PCT/EP2012/053405 dated May 31, 2012.

International Preliminary Report on Patentability PCT/IPEA/416 for PCT/EP2012/053405 dated Apr. 23, 2013.

* cited by examiner

DEVICE FOR SWITCHING BETWEEN LINEAR AND CIRCULAR POLARIZATION USING A ROTATABLE DEPOLARIZER

This application is the national phase under 35 U.S.C. §371 of PCT International Application No. PCT/EP2012/053405 which has an International filing date of Feb. 29, 2012, which claims priority to U.S. provisional patent application No. 61/450,769 filed Mar. 9, 2011.

The present invention relates to a device which is adapted to alter between two modes of operation, such as the detection of linearly and circularly polarized radiation using a rotatable depolarizer and in particular a device having a single motor/actuator for rotating the depolarizer as well as the LNB and depolarizer together.

BACKGROUND

On vessels travelling from Europe to USA and wishing to receive satellite transmitted TV signals, the receiving antenna must be changed, due to the fact that the TV signals in Europe are linearly polarized and those at the USA are circularly polarized. Hitherto, the receiver (LNB) of the antenna—or at least part of it—has usually been physically replaced. A depolarizer is used in the USA to provide linearly polarized radiation for receipt. This is not required in Europe, but in Europe, however, the LNB must be rotated around its longitudinal axis (bore sight), if the vessel rolls about this axis, in order to be able to receive the linearly polarized radiation (the direction of polarization of which is dictated by the satellite and thus is constant during the rolling of the vessel).

In USA, rolling of the vessel is not a problem, as the radiation is circularly polarized, whereby the LNB is not required rotated.

In U.S. Pat. No. 4,806,945, a rotatable depolarizer positioned in the receiving head for providing a receiving head for use with both circularly and linearly polarized radiation. In this patent, the depolarizer is rotated by a motor.

It is noted that in the "linear polarization mode", the depolarizer is positioned either parallel to or perpendicular to the polarization direction of the detector, so that the depolarizer is "invisible" to the radiation. In the "circular polarization mode", the depolarizer is 45° to the polarization direction of the detector in order to convert the circularly polarized radiation to linearly polarized radiation before detection.

Naturally, the same technology may be used for transmitting signals to the satellite(s). In this respect, the depolarizer may be used for adapting the radiation output by a transmitter/antenna, such as a Block UpConverter. Then, angling the depolarizer 45° to linearly polarized radiation will convert this to circularly polarized radiation. Also, angling the polarizer 0° or 90° to the direction of polarization will render the depolarizer "invisible" to the radiation. Thus, the "direction of radiation" may be reversed from a transmitter to a receiver.

SUMMARY

In a first aspect, the invention relates to a system for receiving a signal from one or more satellites or transmitting a signals to one or more satellites, the system comprising:

a frame, a signal converter for converting between a received/transmitted signal and a corresponding signal, the converter being positioned, in relation to the frame, rotational around a predetermined axis, a rotator for rotating the converter in relation to the frame, a depolarizer mounted, in relation to the frame, rotational around the predetermined axis, the system further comprising means for releasably fixing the depolarizer in relation to the converter and at a predetermined rotational relationship.

In this respect, the converter may be either one generating a signal for the satellite(s) or one receiving a signal from the satellite(s). Naturally, a converter may be able to both receive and transmit signals to/from satellites.

A receiving converter may be the so-called LNB (Low Noise Block) which is often used for receiving signals emitted from satellites and converting these to electrical signals. Naturally, the signals may alternatively be converted into optical or wireless signals if desired. It is noted that the signals from the satellites may have any frequency or be within any frequency intervals. Usual radio/TV from geostationary satellites often are within the frequency interval of 10-13 GHz, but other frequencies may be equally useful.

Often, receiving converters are sensitive to a polarization of the signal to be received. This usually is due to the sensing technology used.

The "corresponding" signal may be any signal derived by the receiving converter. This corresponding signal may be a raw output of a sensor, i.e. a signal having the same frequency contents, or may be a filtered signal, such as a signal from which a carrier frequency has been removed.

A transmitting converter may be any type of antenna or transmitter adapted to output signals for transmission to or toward a satellite. A usual converter type is the so-called Block UpConverter (BUC) which outputs radiation based on received electrical signals. As is the situation with the receiving converter, the signals to be converted to radiation for the satellite may be electrical, optical, wireless or be on any other form. The corresponding signal may be converted directly into the output radiation or may be filtered or added to. One manner of adding to a signal is to upconvert the corresponding signal or otherwise provide it on a carrier frequency.

Then, the depolarizer may function to adapt the polarization of the signal before sensing thereof or after output thereof. A depolarizer may simply be a slab of dielectric material positioned within a plane comprising also a direction of the signal or a signal from the satellite to the present system. In this situation the depolarizer may act to convert circularly polarized radiation to linearly polarized radiation or vice versa. The rotational position between the depolarizer and the converter will, when the converter is sensitive to the direction of polarization of linearly polarized radiation, determine how well the linearly polarized radiation generated by the depolarizer will be sensed. Also, if the converter outputs linearly polarized radiation, the angular position will determine whether this linearly polarized radiation is converted into circularly polarized radiation or not.

In addition, rotational positions may exist between the depolarizer and the converter in which linearly polarized radiation to/from the satellite is allowed to pass the depolarizer with no or very little attenuation or alteration.

Depolarizers can be designed in a variety of forms and shapes, such as corrugated all-metal structures, metallic vanes of different shapes and the like.

When the converter is rotatable in relation to the frame, any rotation of the frame, at least around the axis, in relation to the satellite, when the signal output by the satellite has a constant polarization, may be counter-acted by rotating the converter around the frame. As will be described further below, the present invention is very suitable for mounting on or use in relation to vehicles, vessels, trains, airplanes or the like.

The frame thus may be a part of a vessel/vehicle/airplane/train or may be a part mounted thereon, for example.

The rotator may be any type of actuator, such as a motor, such as a stepper motor, or a linear actuator, such as a hydraulically operated actuator, a piezo element or the like. Preferably, the actuation is controllable and quantifiable, so that the rotation may be controlled and quantified.

When the depolarizer is rotatable in relation to the converter, any desired polarization conversion may be performed, and the depolarizer may be rotated to interfere as little as possible, if linearly polarized radiation is emitted from or desired emitted toward the satellite. Preferably, the axis is along a direction from the system toward the satellite.

Naturally, it is irrelevant, when relative rotation is desired, whether the depolarizer or the converter—or both—is/are rotated in relation to the frame.

When the system further comprises means for releasably fixing the depolarizer in relation to the converter and at a predetermined rotational relationship, the depolarizer/converter assembly may then be rotated by the rotator which, when these elements are not fixed to each other, may provide the relative rotation there between.

In one situation, the relative rotational relationship may be one wherein the linearly polarized radiation is allowed to pass the depolarizer and be sensed by the converter. In another situation, the relative rotational relationship may be one wherein the circularly polarized radiation converted into linearly polarized radiation by the depolarizer is directed so as to be sensed by the converter Then, the same rotator may be used for both providing a relative rotation between the depolarizer and the converter and, when the fixing means are operative, a rotation of the depolarizer and converter in concert. This simplifies construction and makes the design cheaper.

Naturally, the releasable fixing means may be of any type, such as a spring operated element increasing and decreasing friction between the two parts so as to interlock these or allow them to rotate independently of each other. This may be like a clutch/brake-like operation. Alternatively, a spring biased element of one of the parts may engage the other part, such as a notch therein.

Naturally, the system may comprise a second means for releasably fixing the depolarizer in relation to the converter at another predetermined rotational relationship, especially if it is desired to facilitate common rotation of the depolarizer and converter with two different angular relationships.

In one embodiment, the system further comprises a first end stop and wherein:

the rotator rotationally engages a first of the converter and the depolarizer, the other of the converter and the depolarizer comprises a part adapted to engage the first end stop when at a first rotational relationship in relation to the first of the converter and the depolarizer.

The end stop may e.g. be stationary in relation to the frame, such as mounted on or fixed to the frame.

When the first of the converter and the depolarizer is rotated and the part of the other engages the end stop, relative rotation of the depolarizer and the converter may be performed. In that situation, the angular relationship between the depolarizer and the converter may be brought toward or away from that in which the fixing means operate or are desired operated.

If this angular relationship is obtained, the fixing means may be automatically operated or may be operated if desired. Then, rotation of the first of the depolarizer and the converter in a direction where the part no longer engages the end stop, with the fixing means operable, will be a rotation of the converter and depolarizer in concert.

On the other hand, rotation with the fixing means operable to and beyond a position where the part engages the end stop may bring the fixing means out of engagement, where after the rotation is of only the first of the depolarizer and the converter.

Therefore, the end stop may be used for bringing the depolarizer and converter to the angular relationship where the fixing means operate or are desired operable, or away from that relationship.

In designs of this type, a stepper motor is preferred, as the operation thereof is highly controllable. In fact, the end stop may also be used for calibrating the stepper motor, or any other type of actuator, as the engagement with the end stop can be detected so as to know the angular position of the depolarizer or converter.

Preferably, the system further comprises a second end stop positioned so that the part is adapted to rotate a predetermined rotational angle between the first and second end stops. The rotation of the part between these defines a window of operation inside which the depolarizer/converter can be rotated during use while e.g. receiving linearly polarized radiation from satellites (or transmitting such radiation toward satellite(s)) in Europe (due to the rolling of the vessel on which the antenna is fixed).

The design then may be so adapted that the rotatable depolarizer, when the part engages the first end stop, is releasably fixed in relation to the converter so that it will rotate with the converter in the "linear polarization mode". When the motor, on the other hand, rotates the part away from the first end stop through the window of operation to the second end stop at the opposite end of the full angle of rotation of the converter/depolarizer, the depolarizer is rotated in relation to the converter and thus brought away from the "linearly polarized mode" and into the "circular polarization mode" (angle).

As described above, the system may further comprise a controller adapted to control the rotator to maintain at least one of the depolarizer and the converter in a predetermined rotational relationship in relation to the satellite receiving/outputting the signal.

Another aspect of the invention relates to a method of operating a system for receiving a signal from one or more satellites or for transmitting a signal to one or more satellites, the system comprising:

a frame, a signal converter for converting between a received/transmitted signal and a corresponding signal, the converter being positioned, in relation to the frame, rotational around a predetermined axis, a depolarizer mounted, in relation to the frame, rotational around the predetermined axis, the method comprising the sequence of steps of:

1. rotating one of the converter and the depolarizer independently of the other of the converter and the depolarizer,
2. fixing the depolarizer in relation to the converter at a predetermined rotational relationship and
3. rotating both the converter and the depolarizer.

Naturally, the method of the second aspect may be for operating a system according to the first aspect. Then, the means and comments made above are equally relevant for the method of the second aspect of the invention.

Naturally, the rotation of the one of the converter and the depolarizer may be a rotation of one of these elements where the other element is stationary in relation to e.g. the frame.

Alternatively, both elements may be rotated but not at the same angular velocity and/or in the same direction.

Preferably, the fixing step is a releasable fixing step which may be followed by a step of releasing the fixing of the converter/depolarizer in the predetermined relationship. As described above, a releasable fixing may be obtained in a number of manners and using a number of different means. Some of these means may operate automatically, such as a biased element extending into a slot, when the two are aligned. Other means are controlled, as e.g. a clutch-like arrangement where friction between the two elements is increased/reduced using e.g. an actuator.

The step of rotating both the converter and the depolarizer is a step of rotating the two while being fixed to each other. Then, no relative rotation takes place.

As described above, the system may comprise a second means for releasably fixing the depolarizer in relation to the converter at another predetermined rotational relationship, or the method may comprise a step of, preferably releasably, fixing the converter and the depolarizer at another rotational relationship.

In a preferred embodiment, steps 1. and 3. are performed using a single rotator, as described above. As is also mentioned, a large number of and types of rotators may be used.

In one embodiment, step 1 comprises rotating one of the converter and the depolarizer in relation to the other of the converter and the depolarizer toward the predetermined rotational relationship. This may be obtained by using the above-mentioned end stop, which may be engaged by the other of the converter and the depolarizer so as to prevent rotation thereof.

In one embodiment, step 3 comprises rotating the converter/depolarizer within a predetermined angular interval. Thus, a window of operation may be provided within which rotation of the converter and depolarizer in concert is possible. This interval may be defined by the above-mentioned two end stops and may be any interval desired. In one embodiment, this interval is a total of 180°.

In one embodiment, the method further comprises, subsequent to step 3., the step of rotating the rotator and the depolarizer to a rotational position where a first of the converter and the depolarizer stops rotating while the other of the converter and the depolarizer remains rotating. This may be obtained by providing the above end stop, which may be stationary in relation to frame, e.g., and which may then be engaged by the rotation stop occurs or is desired to occur.

In one embodiment, step 3. comprises rotating the converter and depolarizer to maintain a rotational relationship in relation to the satellite outputting/receiving the signal.

BRIEF DESCRIPTION OF THE DRAWINGS

In the following, preferred embodiments of the invention are described with reference to the drawing, wherein.

DETAILED DESCRIPTION

Figure 1:
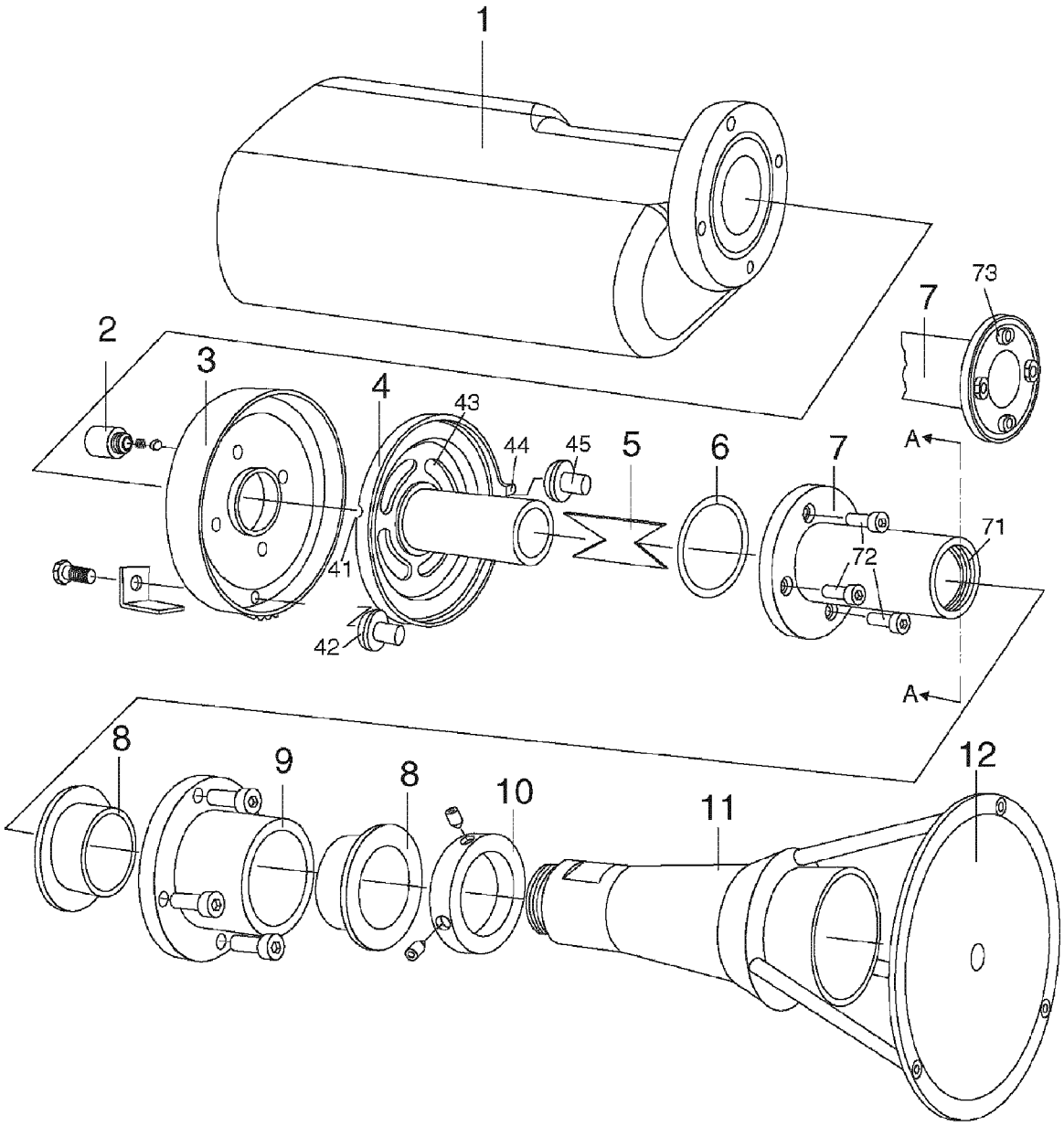
FIG. 1 is an exploded view of a preferred embodiment of the invention.

In FIG. 1, a system for receiving signals from satellites is seen. This system is adapted to alter between two modes, one of which is adapted to receive linearly polarized signals, while being able to rotate the sensor or converter, and the other is adapted to receive circularly polarized signals.

In FIG. 1, the system generally receives the radiation from the satellite (not illustrated) via a main reflector (not illustrated) and a sub reflector 12, from where it is guided via a feed horn 11 past a depolarizer 5 and to a converter 1, usually called an LNB.

Even though the present embodiment is described in relation to receipt of signals from a satellite, the same technology may be used for transmitting signals to the satellite, where the LNB is replaced by a signal transmitter, such as a Block UpConverter (BUC).

The depolarizer 5 is placed in a sleeve, or inner waveguide 4 within a main or outer waveguide 7.

The outer waveguide 7 connects to the feed horn 11 and sub reflector 12 by means of a threaded coupling 71. Plain bearings 8, a waveguide support 9 and a clamping ring 10 ensures that the feed horn 11 and sub reflector 12 can rotate around its longitudinal axis while being immovable along the same axis.

The outer waveguide 7 also connects to the LNB 1 via screws 72. The outer waveguide flange is seated on a belt pulley 3 on four integrated spacing sleeves 73 (see separate illustration illustrating the waveguide rotated 180°) that protrude through inner waveguide slots 43 of the inner waveguide 4. A wave spring washer within the flange 6 exerts pressure on the inner waveguide 4 in order to provide a good radio frequency seal between the inner waveguide 4 and the outer waveguide 7.

The inner waveguide 4 has a flange with four slots 43 allowing a 45° rotation around the longitudinal axis and in relation to the outer waveguide 7 and the belt pulley 3, when the screws extend through the slots 43.

A ball end thrust screw 2 is provided in relation to the belt pulley 3 and which may engage a notch 41 in the inner waveguide 4 to reversibly rotationally lock the inner wave guide 4 in relation to the belt pulley 3, thereby keeping the depolarizer 5 aligned in a predetermined rotational relationship with the LNB 1.

In addition, two mechanical end stops 42 and 45 are provided which may engage a carry pin 44 of the inner waveguide 4.

Two modes of operation are now possible.

A motor (not illustrated) rotates, via a belt (not illustrated), the belt pulley 3 and, via the screws 72, the LNB 1, the outer waveguide 7, the feed horn 11 and the sub reflector 12.

In one mode of operation, the ball end thrust screw 2 engages the notch 41, so that the motor rotates both the inner waveguide 4, and thus the depolarizer 5, and the outer waveguide 7, and thus the LNB 1. Thus, a predetermined polarization or rotation relationship is maintained between the depolarizer 5 and the LNB 1. In this manner, the LNB/depolarizer may be rotated so as to maintain a predetermined rotational relationship to a satellite (not illustrated) outputting the signal to be collected. This rotation may be performed while maintaining the predetermined rotational relationship between the LNB 1 and the depolarizer 5.

Operational range in the first mode is ±90° where −90° corresponds to full counter clockwise deflection, where a carry pin 44 engages an end stop 42, and +90° to full clockwise deflection, where the carry pin 44 engages an end stop 45.

Figure 2:
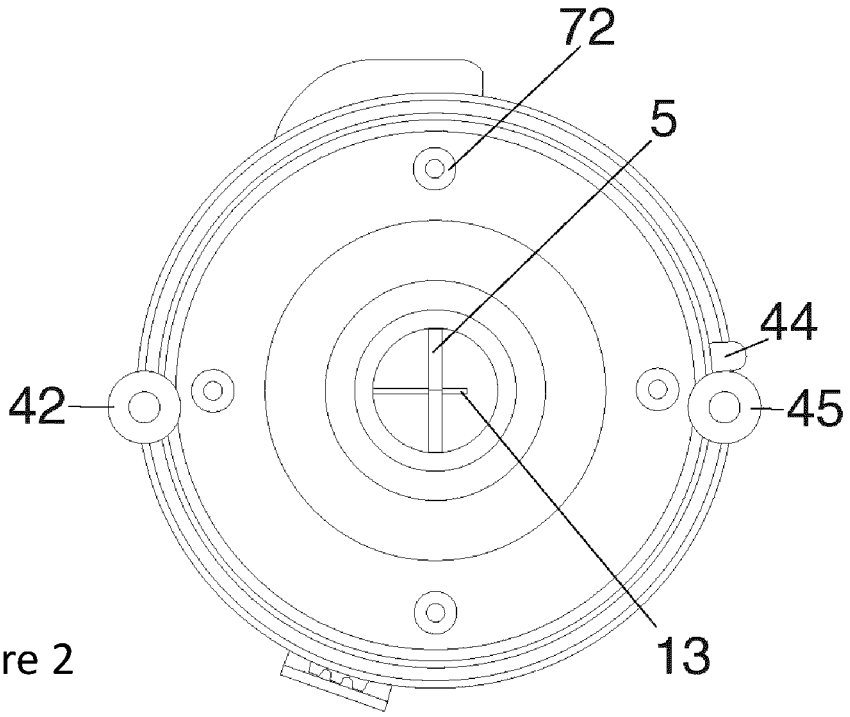
FIG. 2 is a view along the cut A-A in the embodiment of FIG. 1 in a first mode and FIG. 3 is a view along the cut A-A in the embodiment of FIG. 1 in a second mode.

This mode of operation is seen in FIG. 2, which illustrates the system of FIG. 1 from the plane A-A. It is seen that the depolarizer 5 is provided perpendicularly to a sensing element 13 of the LNB 1.

When the depolarizer 5 is perpendicular to—or parallel to—the sensing element 13, it is "invisible" to incoming, linearly polarized radiation. Thus, when this rotational relationship is maintained, the LNB/depolarizer is desired kept in a predetermined rotational relationship to the linearly polarized radiation—and thus the source thereof—which may require rotation of the LNB/depolarizer, if not stationary in relation to the source. This may be the situation, if the system is positioned on a vessel and the source is e.g. a satellite.

Figure 3:
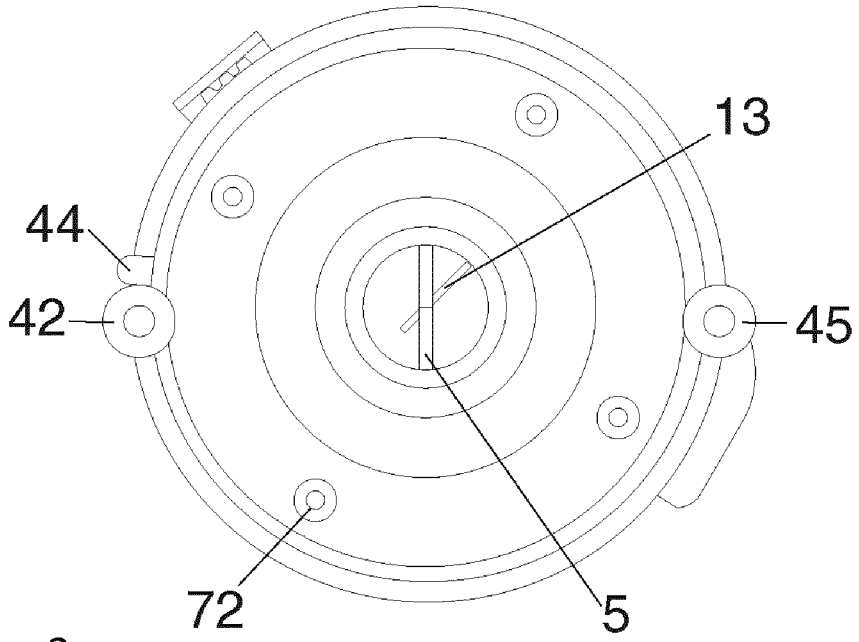

In another mode of operation the depolarizer 5 is desired to be 45° to the sensing element 13 of the LNB 1 (see FIG. 3). In this situation, the depolarizer 5 will convert incoming, circularly polarized radiation to linearly polarized radiation which may then be sensed or detected by the sensing element 13.

To transition from the mode of FIG. 2 to that of FIG. 3, the motor rotates the belt pulley 3, and thus the LNB 1, depolarizer 5, inner waveguide 4, outer waveguide 7, etc. clockwise. At +90° the carry pin 44 engages the mechanical stop 42, where after continued clockwise rotation will force the ball end thrust screw 2 out of engagement with the notch 41. Then, the inner waveguide 4 and thus the depolarizer 5, may be rotated independently of the outer waveguide 7 and the LNB 1.

Then, the motor may rotate the depolarizer 5 within the waveguide 4, with respect to the outer waveguide 7 and LNB 1, to an angle of 45° angle to the LNB polarization. This is obtained at a rotation of +135°, where after the motor stops and locks electrically. The depolarizer 5 is now positioned at a 45° angle to the LNB polarization, which is the mode illustrated in FIG. 3.

To resume operation in the first mode, the motor turns the belt pulley 3 counter clockwise. After a rotation of 180°, the carry pin 44 engages the second mechanical stop 45. Additional rotation rotates the inner waveguide 4 and the notch 41 in relation to the belt pulley 3 and the ball end thrust screw 2. After a rotation of 225°, the thrust screw 2 again locks the inner waveguide 4 to the belt pulley 3, where after coordinated rotation of the depolarizer 5 and the LNB 1 is again possible.

It is noted that any type of rotation and rotational engagement with the outer waveguide 7 and/or the LNB 1 may be used, such as a rotating motor engaging the system using a belt, a chain, a gear, one or more rotating axles or the like. Preferably, a stepper motor or other types of motors, the rotation of which may be controlled and determined, are used. Otherwise, rotational sensors or detectors may be used.

An alternative to rotational motors are linear actuators, such as hydraulically operated actuators or piezo actuators, which may engage the system using any type of gears, levers, converters or the like. As is the situation for rotational actuators or motors, preferably the linear translation is controllable and detectable, but this is not a requirement.

Even though the above is described for a system using a main reflector in conjunction with a centrally located sub reflector the above system is equally useful for any antennas that employ waveguides at some point in their feed systems including horn and lens antennas and other kinds of reflector antennas.

Naturally, instead of rotationally engaging the LNB 1 via the belt pulley 3, the depolarizer 5 may somehow be engaged by the motor, as the coordinated rotation is equally well obtained in that situation, when the ball end thrust screw 2 engages the notch 41, and as the other mode simply requires relative rotation of the depolarizer 5 in relation to the LNB 1.

The invention claimed is:

1. A method of operating a system for receiving a signal from one or more satellites or for transmitting a signal to one or more satellites, the system comprising a frame, a signal converter, a depolarizer, and a single rotator, the signal converter being configured to convert between received radiation or radiation to be transmitted and a corresponding electrical signal, the signal converter being positioned, in relation to the frame, rotational around an axis, the depolarizer being mounted, in relation to the frame, rotational around the axis, the single rotator being configured to rotate the converter and the depolarizer, the method comprising:

fixing the depolarizer in relation to the converter at a first rotational relationship, rotating both the converter and the depolarizer within a desired angular interval, rotating the converter and the depolarizer, in a first direction, past a rotational position where a first end of the converter and the depolarizer engages a first end stop and stops rotating while an other end of the converter and the depolarizer remains rotating, rotating, in the first direction, the other end of the converter and the depolarizer independently of the first end of the converter and the depolarizer to a second rotational relationship, rotating the converter and the depolarizer in a second direction opposite to the first direction, to a position where the first end of the converter and the depolarizer engages a second end stop and stops rotating while the other end of the converter and the depolarizer remains rotating, and rotating the other end of the converter and the depolarizer in the second direction, until the converter and the depolarizer is in the first rotational relationship.

2. A method according to claim 1, wherein the rotating both the converter and the depolarizer within the desired angular interval comprises rotating the converter and depolarizer to maintain a rotational relationship in relation to the one or more satellites outputting the signal.

* * * * *